US006199487B1

(12) United States Patent
Coddington

(10) Patent No.: US 6,199,487 B1
(45) Date of Patent: Mar. 13, 2001

(54) MODULAR PALLET STRUCTURE

(76) Inventor: Leigh Coddington, 31 Joyous Gard Court, Murrumbeena, Victoria 3163 (AU)

( * ) Notice: Subject to any disclaimer, the term of this patent is extended or adjusted under 35 U.S.C. 154(b) by 0 days.

(21) Appl. No.: 09/341,936

(22) PCT Filed: Jan. 21, 1998

(86) PCT No.: PCT/AU98/00029

§ 371 Date: Jul. 20, 1999

§ 102(e) Date: Jul. 20, 1999

(87) PCT Pub. No.: WO98/31595

PCT Pub. Date: Jul. 23, 1998

(30) Foreign Application Priority Data

Jan. 21, 1997 (AU) ..... PO 4691

(51) Int. Cl.[7] ..... B65D 19/12
(52) U.S. Cl. ..... 108/56.1; 108/53.3; 108/53.1
(58) Field of Search ..... 108/54.1, 51.11, 108/53.3, 56.1, 57.1, 53.5, 53.1, 56.3

(56) References Cited

U.S. PATENT DOCUMENTS

| | | | | |
|---|---|---|---|---|
| 3,650,224 | * | 3/1972 | Petix et al. | 108/54.1 |
| 3,857,342 | | 12/1974 | Johns . | |
| 3,938,448 | * | 2/1976 | Nishitani et al. | 108/57.26 |
| 4,095,769 | * | 6/1978 | Fengels | 108/54.1 X |
| 4,694,962 | * | 9/1987 | Taub | 108/54.1 X |
| 4,895,080 | | 1/1990 | Thomas . | |
| 4,993,330 | | 2/1991 | Yen . | |
| 5,094,175 | | 3/1992 | Christie . | |
| 5,105,746 | * | 4/1992 | Reynolds | 108/54.1 X |
| 5,185,193 | | 2/1993 | Phenicie et al. . | |
| 5,204,149 | * | 4/1993 | Phenicle et al. . | |
| 5,505,141 | * | 4/1996 | Barber | 108/56.1 X |
| 5,546,871 | * | 8/1996 | Chapman | 108/54.1 |
| 5,546,872 | * | 8/1996 | Young | 108/56.1 |
| 5,582,113 | * | 12/1996 | Langenbeck | 108/57.26 |
| 5,860,369 | * | 1/1999 | John et al. | 108/56.1 X |
| 5,950,546 | * | 9/1999 | Brown et al. | 108/56.1 |

* cited by examiner

*Primary Examiner*—Jose V. Chen
(74) *Attorney, Agent, or Firm*—Collard & Roe, P.C.

(57) ABSTRACT

The disclosure provides a modular structure, the structure including an upper platform and an underlying support element and structure is provided on at least one peripheral side of the upper platform or the support element for releasably engaging a reciprocal structure on another unit of the structure.

8 Claims, 9 Drawing Sheets

MODULAR PALLET STRUCTURE

FIELD OF THE INVENTION

This invention relates to modular structures and methods for forming larger structures from them. One use to which the invention is particularly (although not exclusively) applicable is in relation to pallets and operations which utilise pallet or load-bearing structures. Accordingly, while the invention is of more general application, the background to the invention will be discussed particularly in relation to pallet technology.

BACKGROUND TO THE INVENTION

Conventional pallet structures suffer from a number of shortcomings. To date, pallets used in warehousing, transportation and storage operations have often been constructed in such a way, and from materials which are in appropriate to lending them to repeated use. For example, conventional pallets have traditionally taken the form of generally open enclosures which are made from wooden slats. Pallet structures of this nature have been used in storage, transportation and warehousing operations for many years. Particularly after an extended period of use, the constructional configuration of such pallets, and the material from which they are made (ie. generally wood), either alone in combination, results in them breaking. When that occurs, it is necessary for them to be replaced, which results in cost (including the cost of interruption of operations) as well as inconvenience to the business which uses them.

Moreover, the traditional wooden pallet is invariably a large structure, which is usually designed so as to be capable of being lifted only by the tines or blade of a forklift or another large vehicle having a similar lifting mechanism. Such pallets are therefore generally not suited to smaller scale lifting operations. In many lifting and storage operations, it would be desirable to have a storage structure which could conveniently be lifted by (for example) the blade of a hand-operated trolley. Conventional pallets of the type previously described are completely unsuitable for such operations.

In some operations involving the transportation of goods, a procedure called "Cross-docking" is (and in many instances, must) be utilised. "Cross-docking" refers to the situation where a "divisible" load of goods under transportation, after reaching a specified destination in the transportation process, is divided or broken down into two or more sub-loads, to enable the sub-loads to be transferred and transported on other vehicles. Typically, "cross-docking" would occur as an intermediate step in the commercial transportation of many goods to the ultimate wholesaling or retail outlet. Cross-docking would be used, for example, with goods that are transported on a large vehicle to a "central" receiving destination, and where different sub-loads of those goods are intended to be on-transported to separate destinations, on smaller or other vehicles. This procedure is not as efficient as it could be, as it frequently requires the original load to be carried on conventional (large) pallets, which (i) must either be removed from the vehicle transporting them to enable the load to be divided, or alternatively (ii) the load must be divided on the vehicle and transferred to the other vehicles involved. Clearly, it would be vastly preferable to be able to transfer sub-loads of the original consignment of goods to other transportation vehicles involved in the process in a more efficient manner. This is not possible with conventional pallets.

In addition, when traditional wooden pallets are not in use, their storage generally requires a considerable amount of space. As under-cover storage costs are generally high nowadays, typically, this means that such pallets are stored outside, and are therefore exposed to the elements. In the case of the wooden pallets. their exposure to the degrading forces of rain and the heat from sunshine only serves to deteriorate their structural integrity all the more. In turn, this increases the possibility of the pallet breaking, over the passage of time.

In addition, conventional pallets are generally stand-alone structures, and are not adapted in use, to engage other pallets so as to form larger load-bearing structures. This operational inflexibility of the conventional pallet is often disadvantageous, particularly where it is desired to use a pallet so as to create a larger load-bearing structure or surface, such as a platform.

It is problems such as these, which have brought about the present invention. The present invention therefore aims to alleviate at least one of the problems of the prior art mentioned previously.

SUMMARY OF THE INVENTION

The invention generally provides a modular structure, the structure including:

an upper platform and an underlying support element; and means provided on at least one peripheral side of the upper platform or the support element, for releasably engaging a reciprocal means on another unit of the structure.

Preferably, the structure is of generally rectilinear shape, when viewed in plan from above or below the structure, so as to define four peripheral sides.

Preferably, the means on one unit of the structure for releasably engaging the reciprocal means of another unit allow the two (or more) units to interlock releasably. Preferably, this is achieved by providing one of the units with at least one projecting flange and the other of the structures with at least a mating receiving flange.

Preferably further, the releasable interlocking action of the units is achieved by moving the projecting flange (or flanges) on one of the units so that the flange(s) align into registry with the receiving flange (or flanges) on the second unit. A preferred form of movement to achieve such engagement is to locate the flanges on one unit, so that they align into registry with the flanges on the other.

Preferably further; each of the units is provided with one or more projection flanges on at least one of its peripheral sides, and with one or more receiving flanges on at least another of its peripheral sides. It is particularly preferred that any one unit of the structure has either projection or receiving flanges on each of its four peripheral sides, and wherein the arrangement of these features is such that where one peripheral side has a projection flange (or flanges), its mutually opposed side on the unit has a receiving flange (or flanges) (and vice versa). It is therefore preferred that each unit of the structure has two sides fitted with projection flanges, and two with receiving flanges, so that each unit is able to releasably engage up to four other units of the structure.

It is further preferred that each structure is formed so as to be capable of receiving a means for moving the structure (such as the tines or blade of a forklift or a hand trolley).

Preferably, this is achieved by providing at least one of the peripheral sides (or the underlying support element) of the structure with a slot or cavity which is adapted to receive such a lifting means. It will be appreciated however that co-operation of the structure with a lifting means can be achieved in any number of ways.

The invention further provides a method of forming a modular assembly, the method including the steps of:

(i) forming the assembly from two or more units of a modular structure, wherein each modular structure includes an upper platform and an underlying support element, and wherein further each unit of the modular structure includes means for releasably engaging a reciprocal means on another unit of the modular structure, and (ii) positioning or moving two or more of the units in such a way that they releasably engage with one another.

Preferably, the step of positioning or moving the units takes the form of locating the units in such a way that they releasably engage with one another.

Preferably, by exercising the method of the invention, a modular assembly in the form of a platform, a large pallet structure or load-bearing assembly is formed.

It is also preferred, in the method, that the units of the modular structure are of generally rectilinear shape when viewed in plan from above or below the units. In this form of the invention, each unit of the modular structure therefore has four peripheral sides.

DETAILED DESCRIPTION OF PREFERRED EMBODIMENTS OF THE INVENTION

Preferred embodiments of the present invention will now be described by way of example only, with reference to the accompanying drawings, in which.

Figure 1:
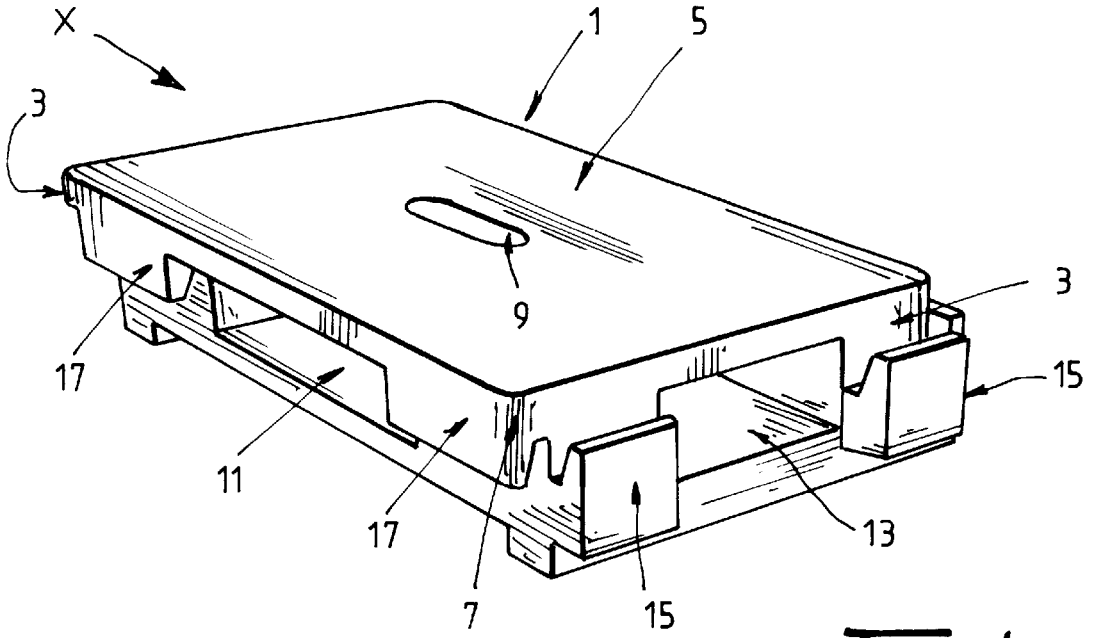
FIG. 1 represents a perspective view of a modular pallet structure constructed in accordance with the present invention.
Figure 2:
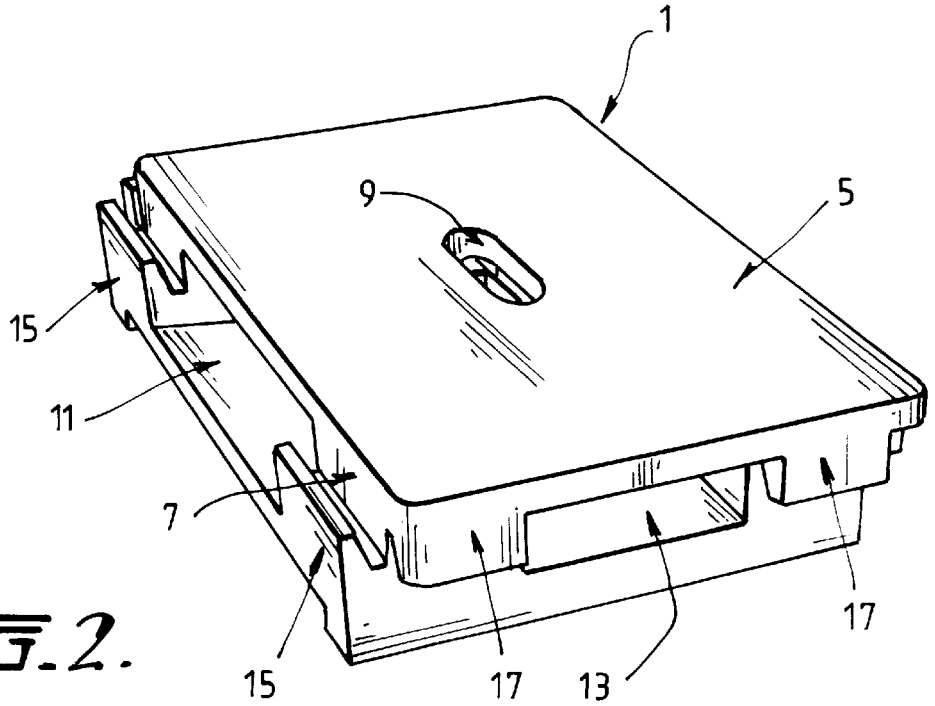
FIG. 2 represents a perspective view of the structure shown in FIG. 1, when viewed generally in the direction of the line "X" in FIG. 1.
Figure 5:
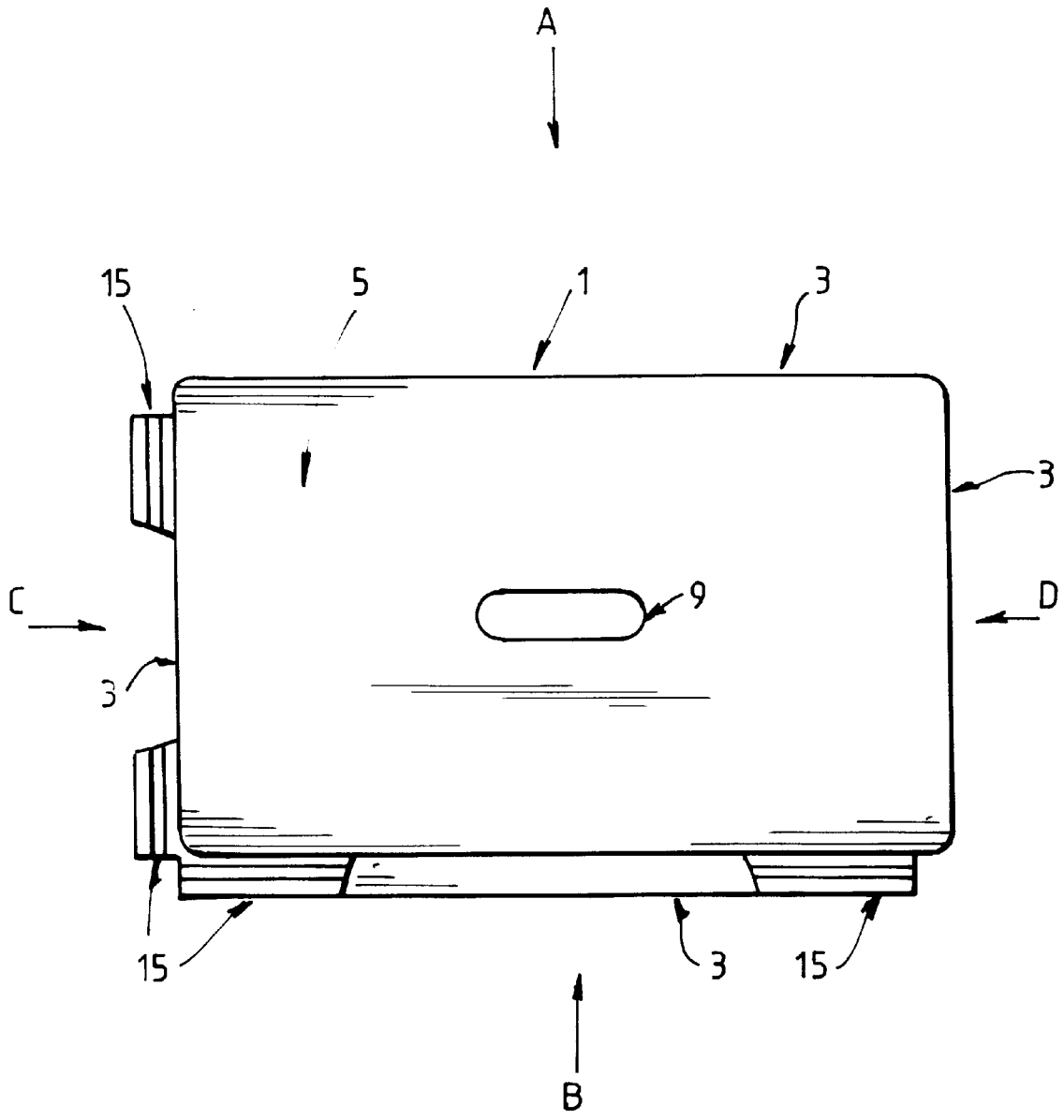
FIG. 5 is a plan view from above of the structure shown in FIG. 1.
Figure 6:
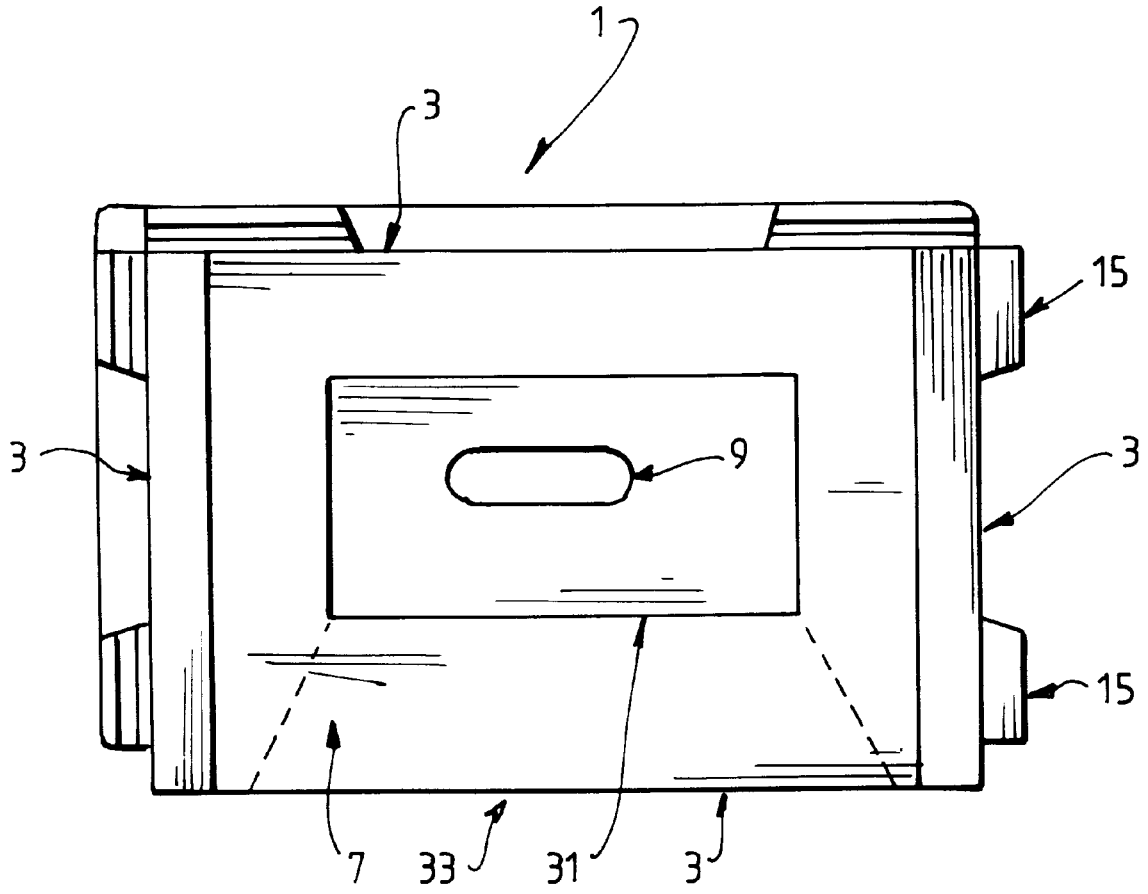
FIG. 6 is a plan view of the structure from underneath.
Figure 7:
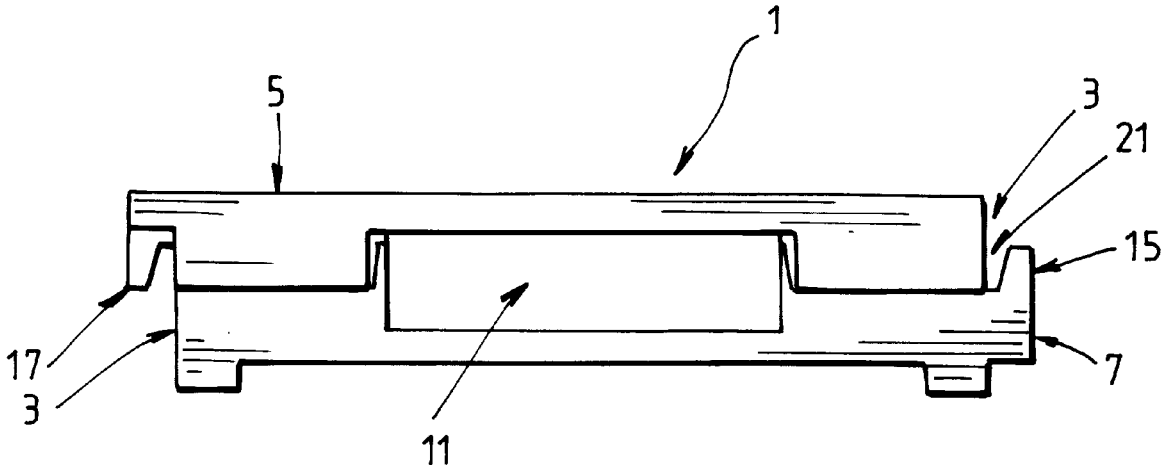
FIG. 7 is a side elevation of the structure shown in FIG. 1 when viewed in the direction of the arrow A shown in FIG. 5.
Figure 8:
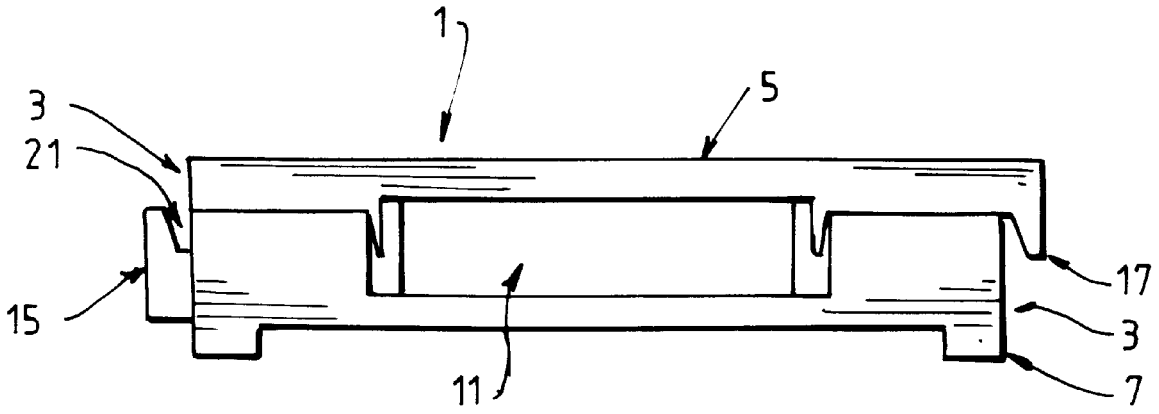
FIG. 8 is a side elevation of the structure when viewed in the direction of the arrow B shown in FIG. 5.
Figure 9:
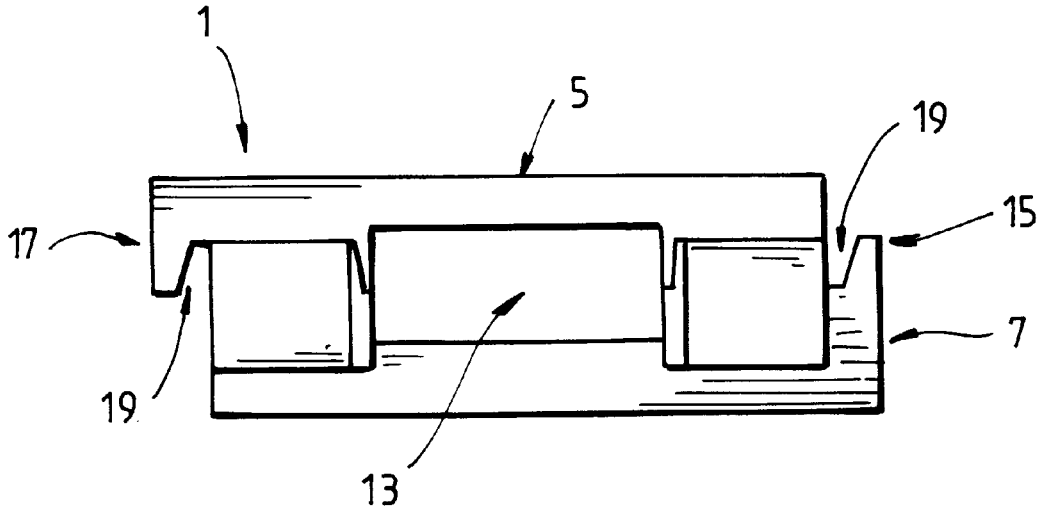
FIG. 9 is an end elevation of the structure when viewed in the direction of the arrow C in FIG. 5.
Figure 10:
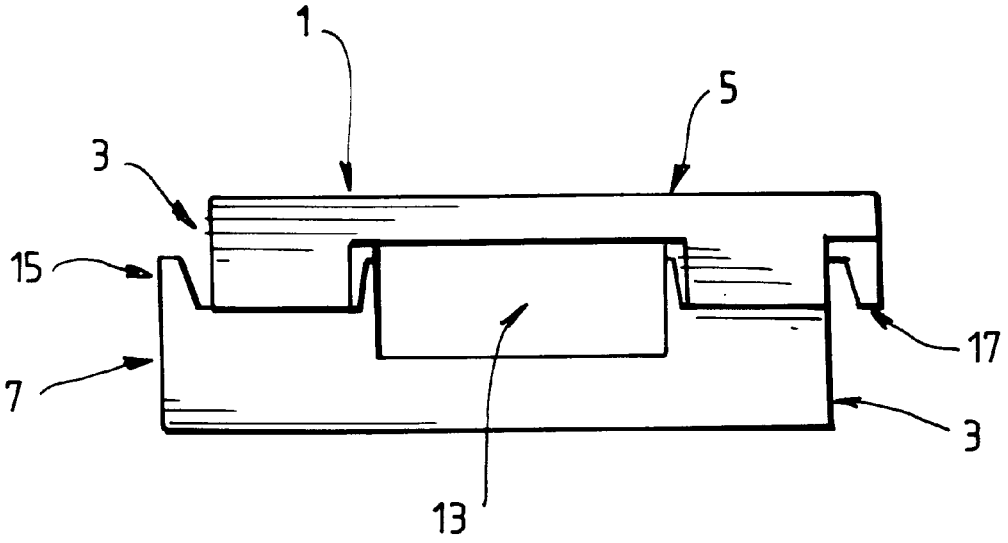
FIG. 10 is an end elevation of the structure when viewed in the direction of the arrow D shown in FIG. 5.

Referring now to the drawings, FIG. 1 shows a modular pallet structure, denoted generally as 1. As can be seen, the depicted modular pallet structure 1 is of generally rectilinear shape when viewed in plan (which is more particularly shown in FIGS. 5 and 6), so that it has four peripheral sides, each denoted 3 in the drawings. The modular pallet structure 1 has an upper platform 5, which is of generally planar configuration. The structure 1 also has an underlying support element, generally denoted 7.

In the illustrated embodiment of the invention, the underlying support element 7 generally takes the form of an open rectilinear enclosure, which includes one opening (or, as shown in the accompanying drawings, a plurality of openings). The front opening 11 is particularly adapted to receive a lifting mechanism, such as, for example, the tines of a forklift (not shown) or the blade of a manually operable trolley (also not shown). The side openings 13 can also be used for a similar purpose, but are intended principally to provide a hand grip to assist in carrying the structure. In the embodiment shown in the drawings, further assistance for carrying the structure is provided by including a slot 9 on the upper platform 5, which is adapted to act as a hand grip. Slot 9 could also act as a "locator", to receive a structure intended to project through the slot and to act as a stabilising or anchoring means, so as to ensure that goods borne on the upper platform 5 do not move in transit. In this respect, those skilled in the art will readily appreciate that the upper platform 5 could contain more than one slot, for the above-mentioned purposes. Those skilled in the art will also appreciate that the slot (or slots) would be inconvenient in some applications of the invention, and in those applications, the slot(s) would preferably either be omitted or concealed. For example. where a plurality of units of the structure are intended to be joined together to form an assembly such as a theater stage or a false floor, then, the slots would preferably be concealed by a mating structure which in use, would give rise to a totally flat surface on the upper platform.

Figure 3:
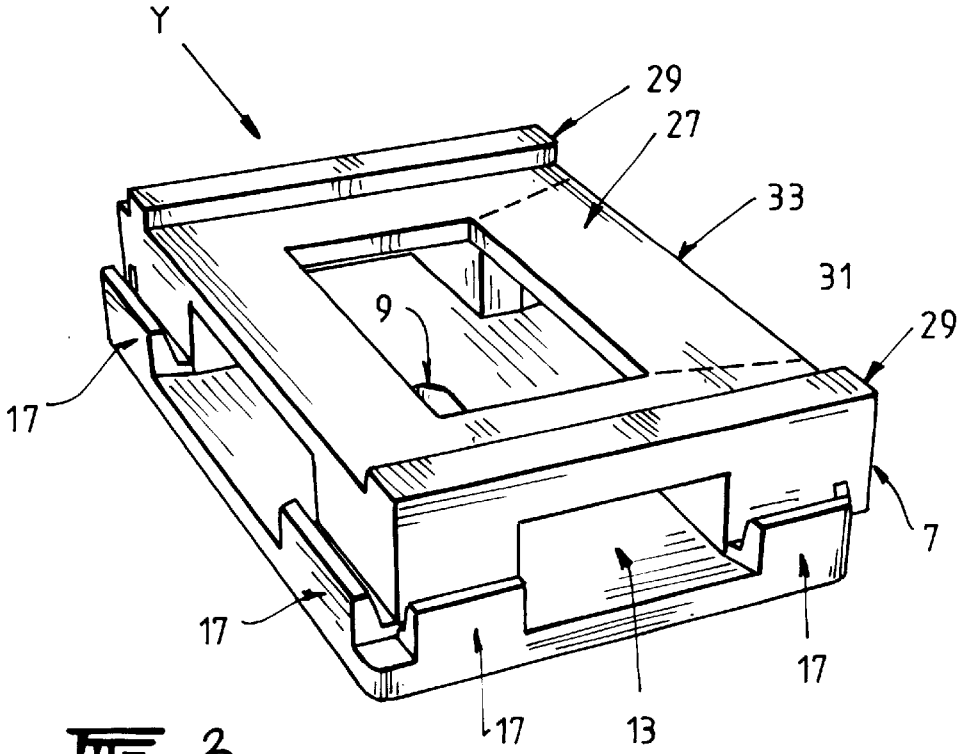
FIG. 3 is a perspective view from underneath of the structure shown in FIG. 1.
Figure 4:
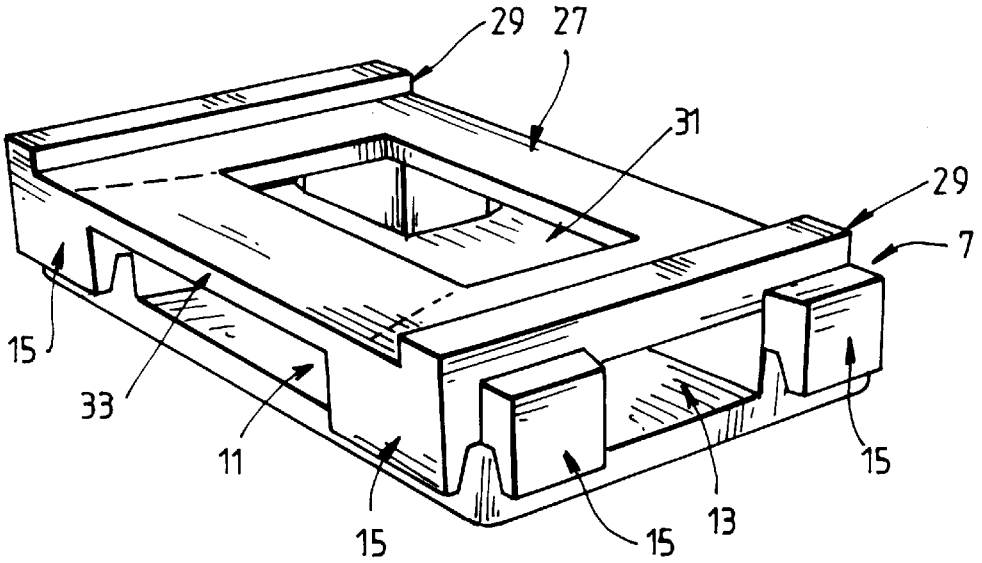
FIG. 4 is a further underneath perspective view of that structure, when viewed generally in the direction of the line "Y" in FIG. 1.

As shown in FIGS. 3 and 4, the illustrated embodiment of the unit has an underlying support which includes a generally planar base platform 27, which is bounded by each of the peripheral sides 3 of the structure. In the exemplary embodiment depicted, base platform 27 has two base mounts 29, and a generally rectilinear opening 31. As shown by the broken lines in those two figures, in an alternative embodiment, the opening would assume a generally more open configuration whereby the area of the base platform bounded by the broken lines and the peripheral side 33 of the structure, would be omitted from the structure. In this alternative embodiment, the configuration of the structure would facilitate the tine or blade of a forklift grasping and lifting the structure, so that such a tine or blade could slideably engage the structure from underneath.

In terms of its construction or manufacture, a unit of the structure can be formed so that the upper platform 5 and the underlying support element 7 are integral with one another, or they can be made as separate components and then joined together by any suitable means.

As shown in the drawings, the modular structure 1 includes a plurality of means to enable it to releasably engage other units of the structure. In the illustrated embodiments of the invention, the means for releasably engaging other units take the form of providing the structure 1 with on or more generally upwardly projecting flanges (denoted as 15) and generally downwardly projecting flanges (denoted as 17). As shown in the accompanying drawings, each unit of the structure 1 is fitted with two flanges on each of its peripheral sides 3. As will be seen from the drawings, the two flanges on any one peripheral side 3 of the unit are of the same orientation to one another (ie. on any one peripheral side 3, both the flanges are either upwardly or downwardly projecting). The arrangement of the flanges on the illustrated structure 1 is also such that the flanges on any one peripheral side 3 have an orientation opposite to those on the peripheral side mutually opposite to it. Accordingly, in the illustrated embodiment of the invention, each unit of the structure has two pairs of upwardly projecting flanges 15 and two pairs of downwardly projecting flanges 17. This arrangement allows two or more units of the structure 1 to be juxtaposed, and moved or positioned into engagement with each other. It should be noted that in other embodiments of the invention, any peripheral side 3 of the modular structure 1 could simply have only one flange, which could extend part or all the way along the length of that side. As can be seen from the drawings, the flanges are shown (in the illustrated embodiments) as taking the form of "open" structures, that is, where in use, adjoining units of the structure can readily be engaged and disengaged, as desired. In some applications of the invention however, it would be preferred to lock or secure adjoining units in a more fixed manner, to prevent them moving relative to one another. Preferably the means used to lock or secure adjoining units together would also enable them to be unlocked and disengaged, as desired.

Each unit of the structure 1 is able to be used as an individual pallet, platform or supporting structure, and can be constructed so as to be of a size suitable for manual lifting, transportation or storage operations. In a particularly preferred embodiment of the invention, the illustrated structure 1 is sized such that the blade of a hand trolley is able to engage the front opening 1 of the structure, and thereby lift it (and a load placed on it).

Figure 11:
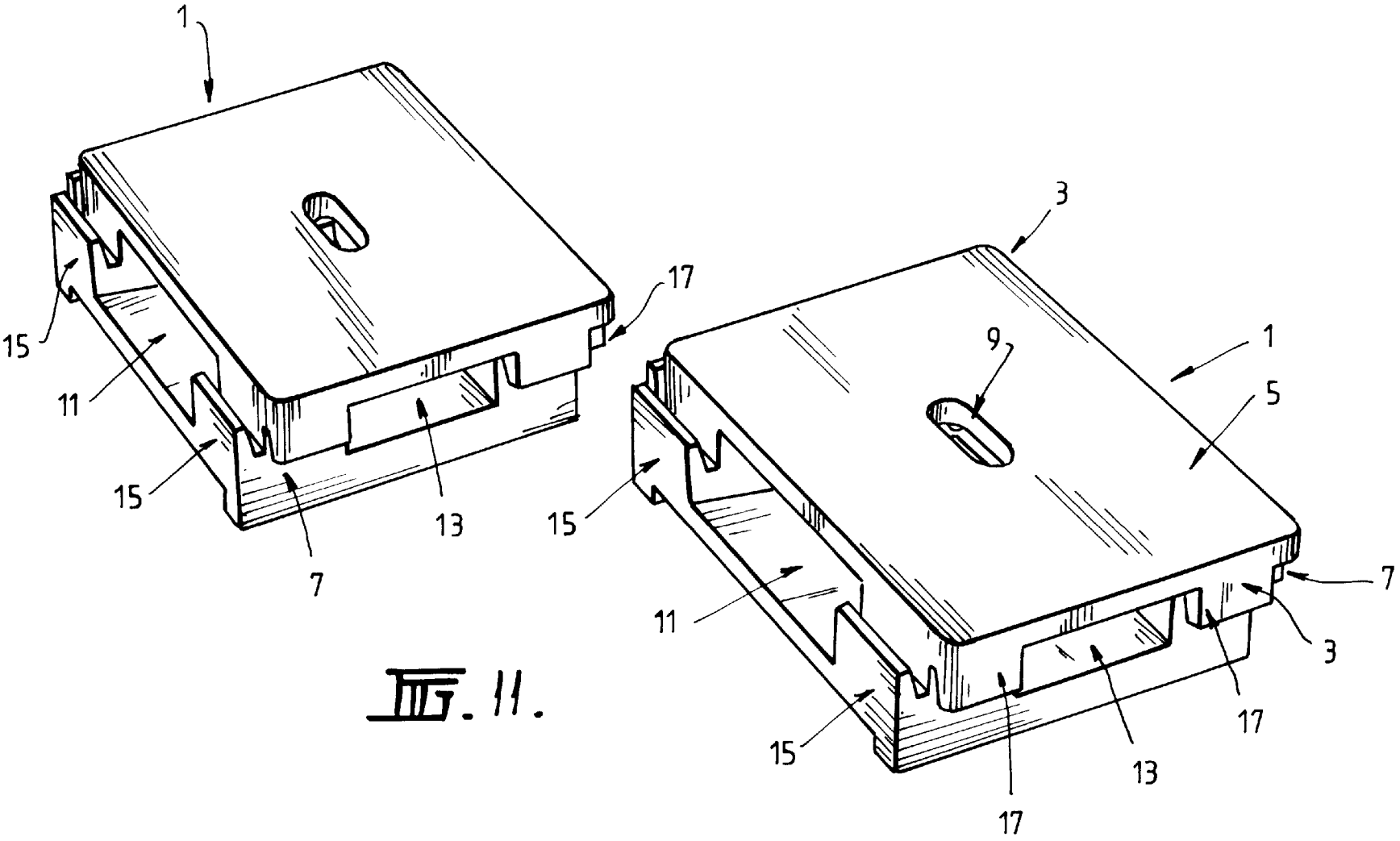
FIG. 11 depicts two units of a modular structure constructed in accordance with the invention, and a motion by which they may be releasably engaged.
Figure 12:
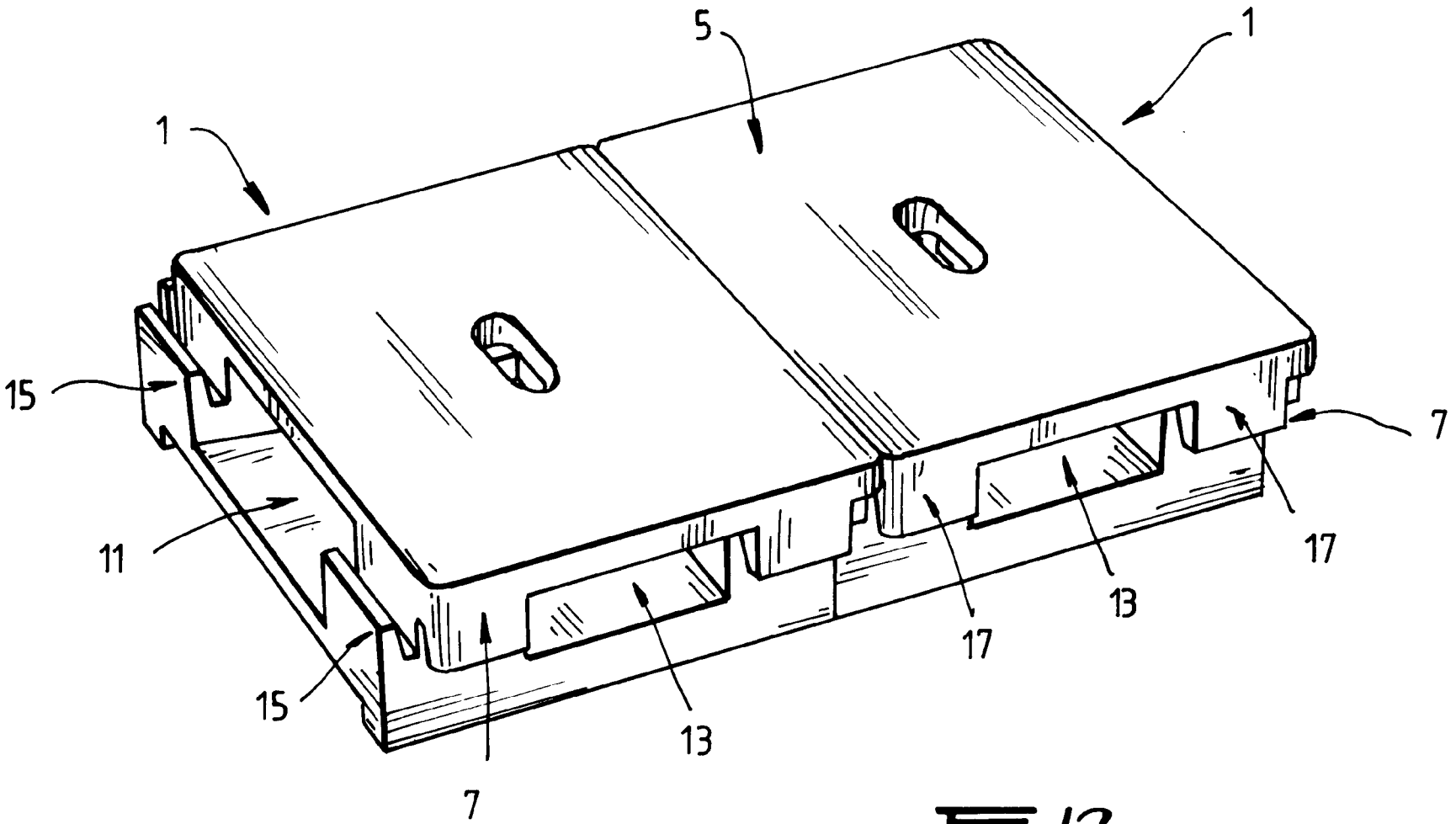
FIG. 12 shows the two units of FIG. 11 in the engaged position.
Figure 13:
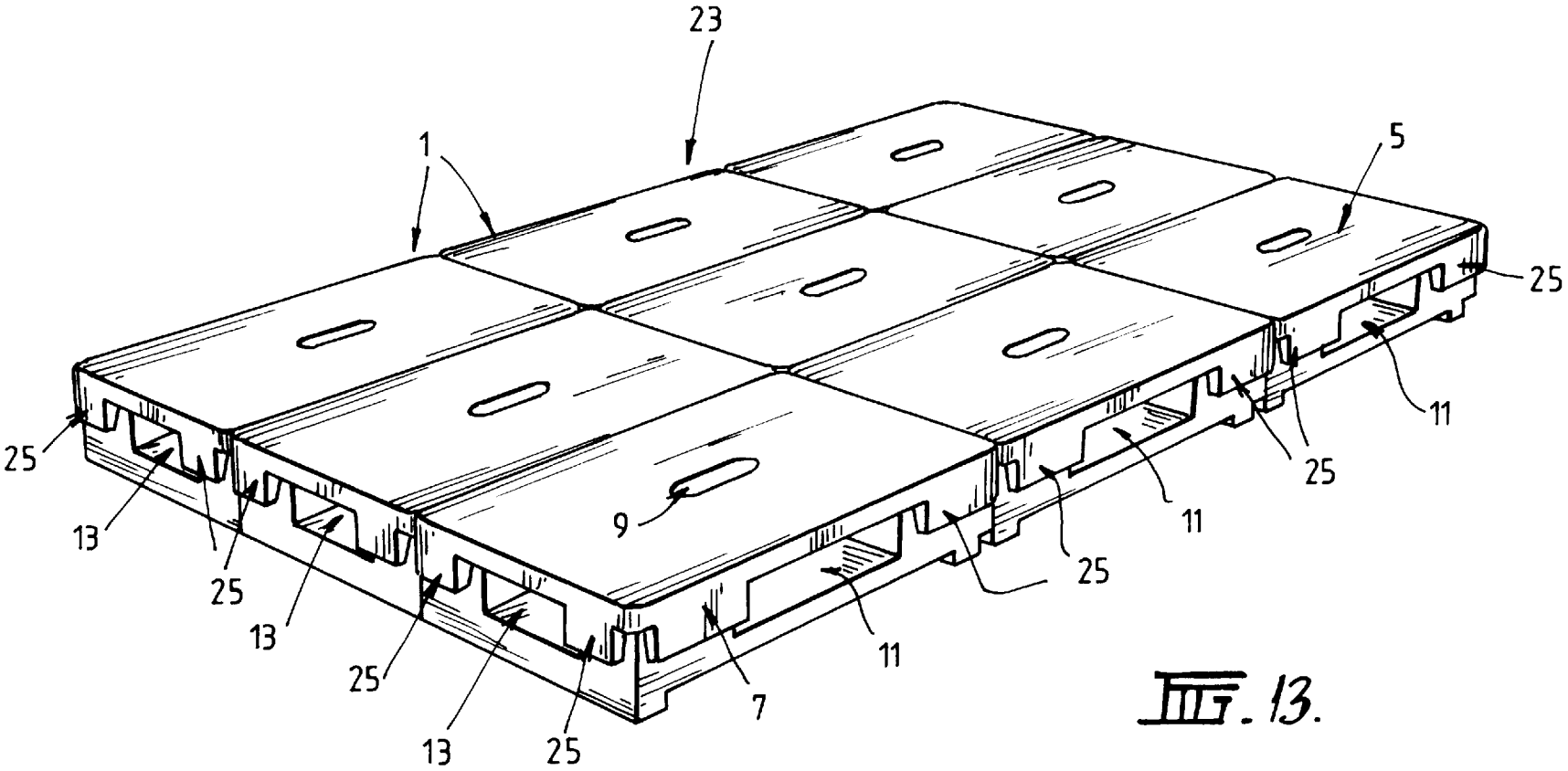
FIG. 13 depicts a modular assembly constructed in accordance with the method aspect of the invention.

As shown more particularly in FIGS. 7, 8, 9 and 10, the flanges on a unit of the structure 1 project outwardly of each peripheral side 3 of the structure. Each flange in this embodiment of the invention is shown to be of a generally wedged shape, when viewed in cross-section. In the illustrated embodiments, the inner slope 19 of each flange, together with its adjacent peripheral side 3, act so as to define a generally "wedge"—or "V"—shaped channel 19, which is adapted to receive, in a releasable fashion, a mating flange from another unit of the structure. Accordingly, and as shown more particularly in FIGS. 11 and 12, by locating two or more units of the structure together, so that the flanges of one unit engage with the mating flanges of another unit, two or more such units can be engaged so as to form a larger assembly. Such an assembly (generally denoted 23, and which, as depicted, is formed from nine modular pallet structures 1 of the kind particularly described herein) is shown in FIG. 13. It can be seen from that drawing, that by interlocking those units in the manner described above, a structure of virtually any desired size or area can readily be formed, and when required, easily dismantled. A modular assembly of the kind depicted in FIG. 13 could conveniently be used for example, on a transportation vehicle, so that each unit of the modular structures 1 from which the assembly is formed could carry an individual load of goods. It would then be a relatively simple matter to disassemble the assembly 23, and to dispatch the individual loads of goods carried on them to their desired destinations, so as to render a procedure such as "cross-docking" more time and cost efficient.

Although the illustrated assembly 23 has been described particularly for use as a modular pallet assembly, its use is by no means limited to that purpose. An assembly like the assembly 23 shown in FIG. 13 could readily be used as an assembleable/disassembleable stage for a public event, or as a wall or other construction surface. In order to render the appearance of the assembly 23 more aesthetically pleasing, the peripheral units 25 of the assembly could interlock with other units (not shown) so as to give rise to a contiguous peripheral "trim" or "border", as desired. This would ensure that the outlying flanges 25 on the peripheral units were concealed, so as to give a more aesthetically acceptable appearance to the assembly. Additionally, in warehousing operations, where pallets laden with goods are often stacked vertically so as to maximise the use of floor space, an assembly such as the one depicted in FIG. 13 would also be most useful, as, it could be removed from storage (as with any other pallet), and then conveniently disassembled on the ground so as to yield individual pallets with their own sub-loads. Depending on the nature of the vertical storage mechanism utilised on a particular site, in some instances it might be necessary or desirable to reinforce the structural strength of the stored assembly 23, by inserting a reinforcement means (such as a solid rod or similar structure—which has not been shown in the accompanying drawings) through each of the side openings 11 and/or 13 of the assembly 23, and substantially or fully along its length and/or width. In some instances, this might be necessary to ensure that the assembly—when suspended above the ground without a support which would prevent the assembly from folding downwardly—remains intact as a rigid horizontal platform.

The modular support structures 1 of the invention can be made from any suitable material (or combinations of materials), including plastics, metal, wood as well as others, and by any number of methods (eg, in the case of plastics, by injection moulding). Generally, a material will be suitable for use in this regard if it yields a structure which is rigid and capable of supporting a load of the kind intended to be borne on it.

As indicated above, modular structures (and assemblies) made in accordance with the present invention are able to be put to many uses. It is also to be understood that such structures and methods of using them to form assemblies are capable of many modifications and/or variations, without departing from the spirit and scope of the present invention. Thus, the spirit and scope of the invention is by no means limited to the particular constructional or other details of the structures and methods specifically disclosed in this specification, but extends generally to all modifications of and variations to the invention which would be apparent to those skilled in the art.

It is to be understood that wherever used herein, forms of the word "comprise" are equivalent in meaning to forms of the word "include", and are therefore not to be taken as excluding the presence of any integer, feature or combination of integers or features.

The claims defining the invention are as follows:

1. A modular structure having four peripheral sides when viewed in plan form above or below the structure, comprising:

(a) an upper platform having a generally rectilinear shape;

(b) an underlying support element;

(c) two mutually opposed peripheral sides of the structure are each fitted with at least one projection flange but no receiving flanges;

(d) two mutually opposed peripheral sides of the structure are each fitted with at least one receiving flange but no projection flanges;

(e) the projection flanges on one unit of the structure are adapted to engage and cooperate with the receiving flanges on another unit of the structure, so that in use, two or more units of the structure are capable of being releasably locked or joined together, without the need for any additional locking or joining means.

2. A modular structure as claimed in claim 1, wherein the releasable interlocking or joining of adjoining units of the structure is achieved by moving the flanges on one unit of the structure into alignment with one or more reciprocally structured flanges on an adjoining unit (or adjoining units) of the structure.

3. A modular structure as claimed in claim 1, wherein:

(i) where a peripheral side of the structure is provided with at least one projecting flange, its mutually opposed side on the structure is fitted with at least one receiving flange; and (ii) where a peripheral side of the structure is provided with at least one receiving flange, its mutually opposed side is fitted with at least one projecting flange.

4. A modular structure as claimed in claim 1, in which the structure is formed so that it is capable of receiving a means for moving the structure.

5. A modular structure as claimed in claim 4, in which at least one of the peripheral sides of the structure (or the underlying support element) comprises a slot or cavity which is adapted to receive a means for moving the structure or an assembly of two or more units made from locked or joined units of the structure.

6. A modular structure as claimed in claim 5, wherein the slot or cavity is adapted to receive the tines or blade of a lifting means.

7. A modular structure as claimed in claim 6, wherein the lifting means comprises a device selected from the group consisting of a forklift and a trolley.

8. A modular structure as claimed in claim 1, wherein the structure is a pallet.

* * * * *